US005099553A

United States Patent [19]

Dischler

[11] Patent Number: 5,099,553

[45] Date of Patent: Mar. 31, 1992

[54] METHOD AND APPARATUS FOR TREATMENT OF THERMOPLASTIC FABRIC HAVING UPRIGHT PILES

[75] Inventor: Louis Dischler, Spartanburg, S.C.

[73] Assignee: Milliken Research Corporation, Spartanburg, S.C.

[21] Appl. No.: 602,838

[22] Filed: Oct. 24, 1990

[51] Int. Cl.[5] ..... D06C 29/00

[52] U.S. Cl. ..... 26/2 R

[58] Field of Search ..... 29/121.1, 121.2, 121.4, 29/121.5; 26/2 R

[56] References Cited

U.S. PATENT DOCUMENTS

| | | | |
|---|---|---|---|
| 2,273,710 | 2/1942 | Klaes | 29/121.2 X |
| 2,320,891 | 6/1943 | Ryder, Jr. | 29/121.1 |
| 2,970,362 | 2/1961 | Rankin et al. | 26/2 |
| 3,519,129 | 7/1970 | Peterson | 29/121.2 X |
| 3,564,637 | 2/1971 | Gollish | 29/121.5 X |
| 3,589,147 | 6/1971 | Price et al. | 68/5 |
| 3,614,821 | 10/1971 | Qualheim | 29/121.5 |
| 3,739,436 | 6/1973 | Naujoks et al. | 26/2 R |
| 3,739,483 | 6/1973 | Meier-Windhorst | 34/23 |
| 3,997,946 | 12/1976 | Hergert | 26/2 R |
| 4,021,894 | 5/1977 | Poterala et al. | 29/121.2 X |
| 4,301,577 | 11/1981 | Mueller et al. | 26/2 R |
| 4,627,137 | 12/1986 | Wildt | 29/121.4 X |
| 4,947,528 | 8/1990 | Dischler | 26/2 R |

FOREIGN PATENT DOCUMENTS

| | | | |
|---|---|---|---|
| 1276585 | 9/1968 | Fed. Rep. of Germany . | |
| 3031665 | 4/1982 | Fed. Rep. of Germany . | |
| 3126966 | 5/1988 | Japan | 26/2 R |

*Primary Examiner*—Werner H. Schroeder
*Assistant Examiner*—John J. Calvert
*Attorney, Agent, or Firm*—Kevin M. Kercher; H. William Petry

[57] ABSTRACT

A method and apparatus for continuous treatment of a web of thermoplastic pile fabric comprising heating the fabric to a temperature between the dyeing and heat setting temperature of the fabric, then vibrating the fabric biaxially by means of a rotating cylindrical roll with spaced protrusions or depressions along the exterior surface of the cylinder followed, optionally, by vibrating the fabric uniaxially by means of a second rotating cylindrical roll having flat portions continuously extending along the longitudinal axis of the second cylinder. The repeated and rapid front to back and side to side movement of individual pile fibers caused by multiple vibrational waves during biaxial treatment allows the fibers to return to their preferred heat-set orientation.

41 Claims, 5 Drawing Sheets

METHOD AND APPARATUS FOR TREATMENT OF THERMOPLASTIC FABRIC HAVING UPRIGHT PILES

BACKGROUND OF THE INVENTION

This invention relates to improved method and apparatus for removing pile distortions in thermoplastic fabric created by heat-setting and/or dyeing.

In the case of pile fabrics, which have been heat set at a high temperature with the pile erect and then dyed at a lower temperature during which the pile is substantially disturbed, as in jet dyeing, it is then desired to have the pile return to its original erect condition. One attempt in solving this problem is the tensionless dryer. In this machine, the pile fabric is fed onto a mesh belt which is then transported through a long heated tunnel where either mechanical action or perpendicular air blasts directed at the belt cause the fabric to undergo rather gentle undulations. The fabric is statically charged by friction with the air or contact with various parts of the dryer. The required processing time results in a drying unit over one hundred feet long with a low fabric line speed. There are quality problems associated with a lack of control over the fabric for such a long distance and well as marks that occur when the fabric strikes the upper section of the tunnel.

Another type of pile conditioning device is the use of a high velocity air jet such as U.S. Pat. No. 4,837,902. In this case, the fabric is heated to the desired temperature and the conditioning is accomplished almost instantaneously by vigorous sawtoothed shaped waves which are small in amplitude, but effective due to high accelerations normal to the fabric surface produced by the wave's small bending radius and high velocity. The disadvantage of this process is direct& contact of the heated fabric with the air stream, which tensions the fabric and can set in distortions in sensitive knit fabrics. Also, this process is less effective with highly permeable fabrics, as the air may not be trapped between the fabric and plate.

Yet another type of device vibrates and charges the pile fabric in the heated condition by contact with pneumatically excited diaphragms. The contact of the fabric with the diaphragms combined with the rapid vibrations induced by the air stream cause the diaphragm to wear out a rate in which replacement can be a daily occurrence.

The present invention solves the above problems in a manner not disclosed in the known prior art.

SUMMARY OF THE INVENTION

A method and apparatus for continuous treatment of webs of thermoplastic fabric having an upright pile comprising heating the fabric to a temperature between the dyeing and heat-setting temperature of the fabric, then vibrating the fabric biaxially by means of a rotating cylindrical roll with spaced protrusions or depressions along the exterior surface of the cylinder, followed by optionally vibrating the fabric axially by means of a second rotating cylindrical roll having flat portions continuously extending along the longitudinal axis of the second cylinder. The repeated and rapid front to back and side to side movement of individual pile fibers caused by multiple vibrational waves during biaxial treatment allows the fibers to return to their preferred heat-set orientation.

An advantage of this invention is that axially adjacent biaxial vibrators are spaced circumferentially far enough apart in order to individually excite the fibers rather than acting as units of two or more elements.

It is a another advantage of this invention to allow the fabric maximum vibration due to biaxial vibration.

Yet another advantage of this invention is an alternative fabric route for those fabrics particularly sensitive to streaks to bypass a biaxial roll in favor of a uniaxial roll.

Still another advantage of this invention is that the fabric is under near minimum tension while at maximum temperature which is accomplished by heating the fabric as it travels downward, with vibrator rolls situated directly below the lowest edge of the heater, with a short tension control loop directly after the vibrator rolls.

Another advantage of this invention is that no static charge is required to be built up in the fabric in order to remove crush in the pile. Even when the fabric has been treated with a anti-static agent, the biaxial vibration of the pile is vigorous enough to allow the pile to recover the desired orientation.

These and other advantages will be in part obvious and in part pointed out below.

BRIEF DESCRIPTION OF THE DRAWINGS

The above as well as other objects of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
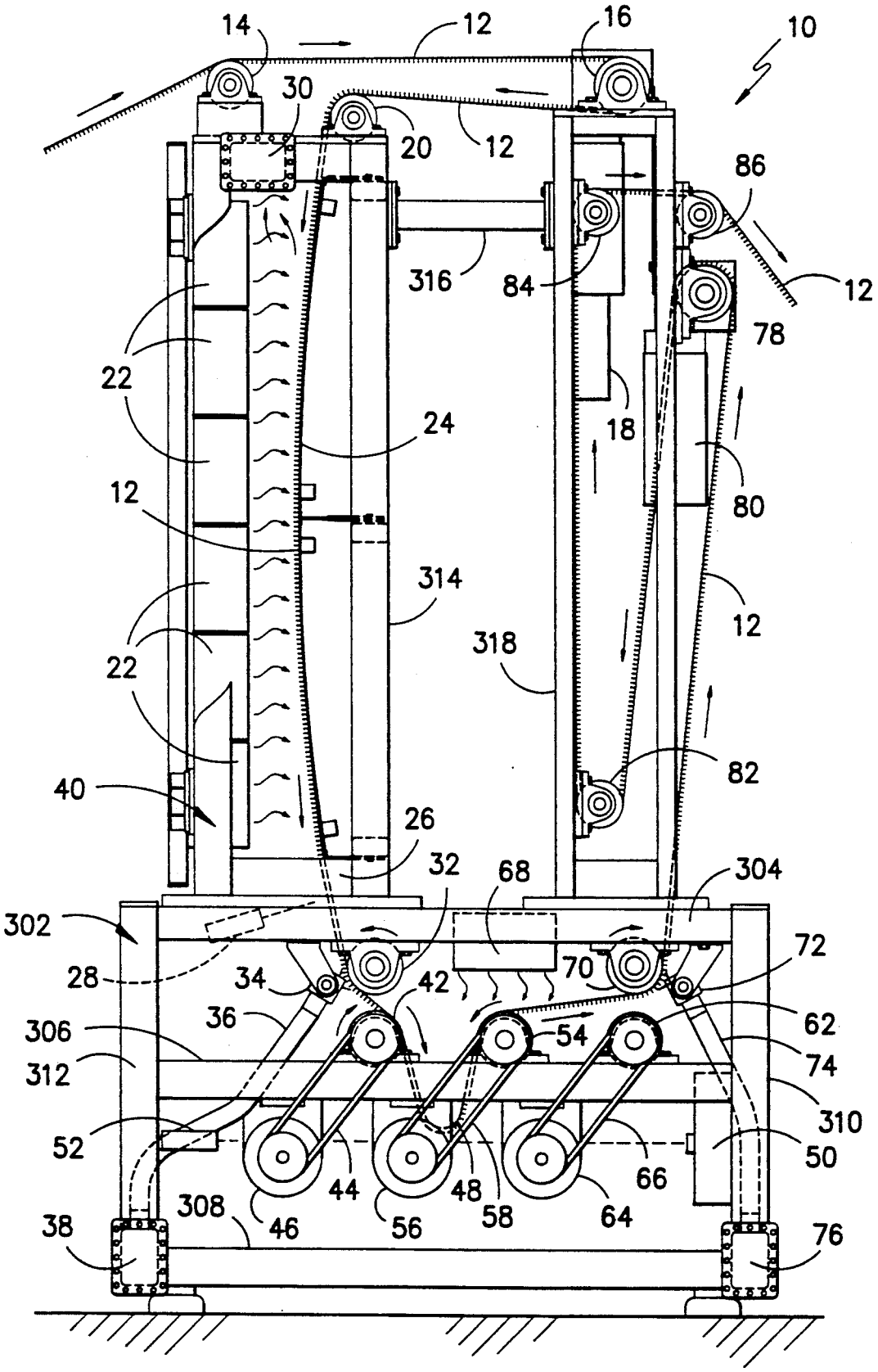
FIG. 1 is a left side elevational view of the apparatus constructed according to the present invention with the fabric contacting two biaxial rolls and two uniaxial rolls.
Figure 2:
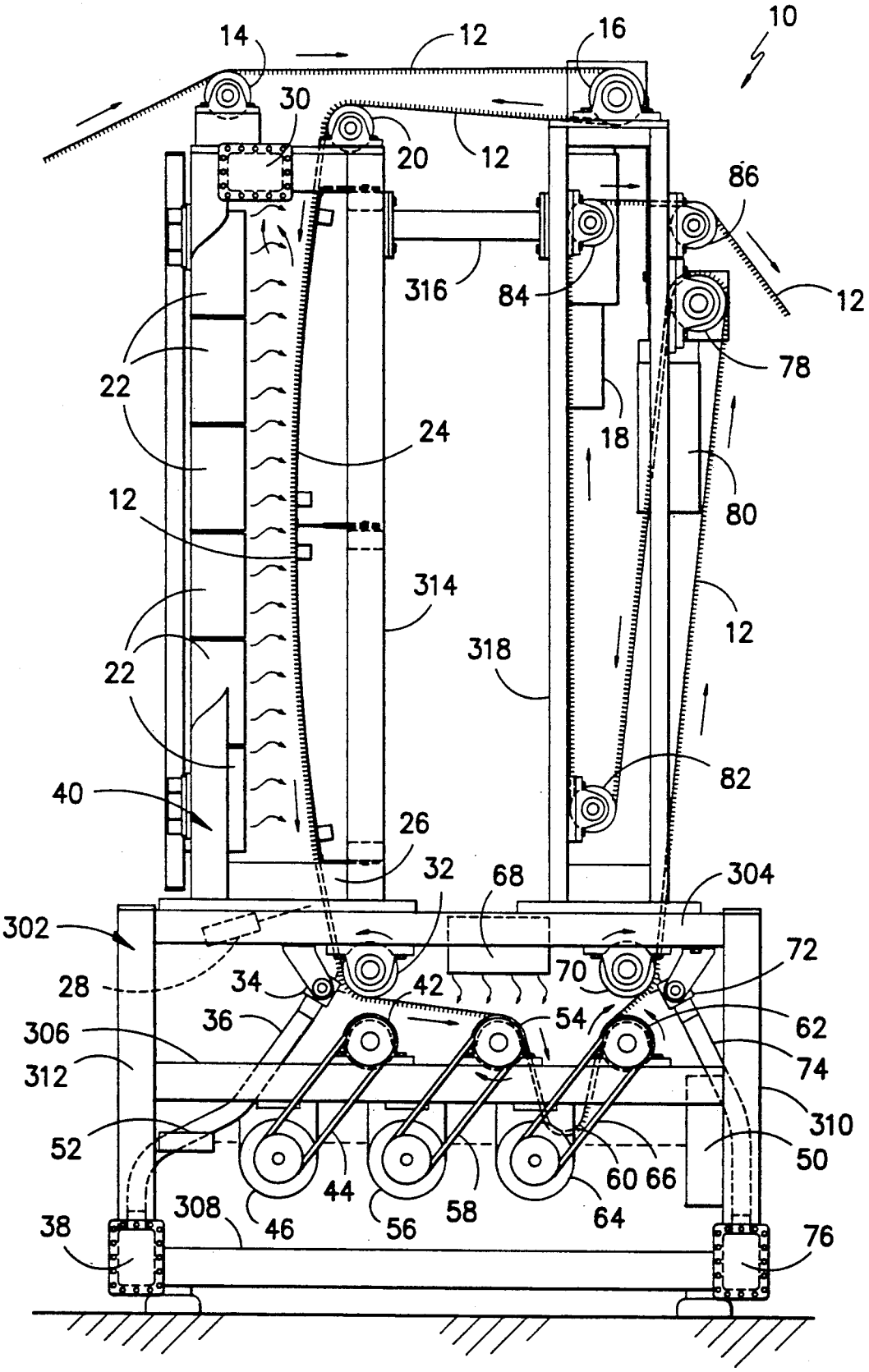
FIG. 2 is a left side elevational view of the apparatus constructed according to the present invention with the fabric contacting only one biaxial roll and an additional uniaxial roll.
Figure 3:
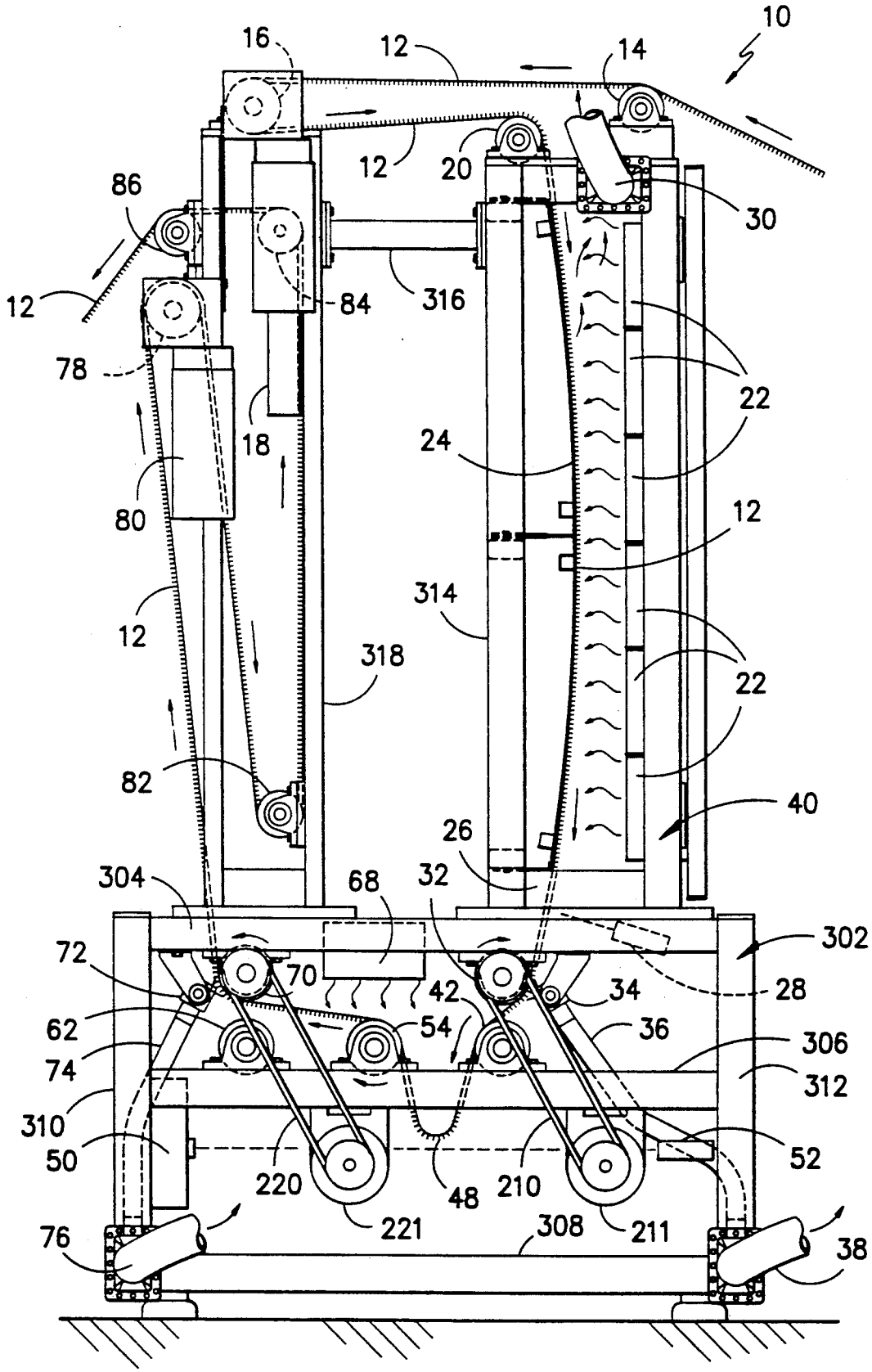
FIG. 3 is a right side elevational view of the apparatus constructed according to the present invention with the fabric contacting two biaxial rolls and two uniaxial rolls.

Referring now by reference numerals to the drawings, and first to FIGS. 1–6, an assembly to erect pile fabric is generally indicated by numeral 10. Referring now to FIGS. 1, 2, and 3, pile fabric 12 is supplied to the assembly 10 with the pile side down. The fabric 12 first makes contact wi&:h a first idler roll 14 when entering the apparatus 10. The fabric 12 then wraps around drive roll 16 which transports the fabric 12 into the assembly 10. This drive roll 16 is powered by a lead drive motor 18. The pile fabric 12 is then directed downward by a second idler roll 20 past a bank of six radiant heaters 22 which applies heat to the face of the pile fabric 12. There is a convex steam heated plate 24, which is typically charged with 30 p.s.i.g. steam and is in contact with the back of the pile fabric 12. At the lowest point in the heated zone 26, the pile fabric 12 should be at its maximum temperature, which should be above the dyeing temperature but below the heat-setting temperature of the pile fabric 12. The typical operating temperature for a polyester fabric lies in the range of 280 to 340 degrees Fahrenheit. The radiant heating elements 22 are controlled by monitoring the temperature of the pile fabric 12 at a point just below the heated zone by means of an infrared pyrometer 28. Fumes which evolve when the pile fabric 12 is heated up to this temperature are removed by means of a first exhaust manifold 30 located at the top of the heated zone.

The pile fabric 12 after leaving the heated zone then makes contact with a first biaxial vibrator roll 32 which is rotating in a counter-clockwise direction in FIGS. 1 and 2. The vibrator roll 32 is driven by a belt 210 connected to a motor 211, as shown in FIG. 3. The axis of any vibrating roll is the longitudinal axis. Any lint carried by the fabric at this stage is typically ejected an inch or so above the face of the pile fabric 12 by means of the first biaxial vibrator 32. At this point, the lint would be attracted back to the pile fabric 12 by static charges. However, this apparatus 10 has a vacuum head 34 which suctions the lint off before it can be redeposited. The vacuum head 34 is connected by flexible hose 36 to an second exhaust manifold 38 located near the bottom of the apparatus 10 and built into the apparatus frame 40.

The face of pile fabric 12 is then treated by the second biaxial vibrator roll 42, which is rotating in a clockwise direction in FIGS. 1 and 2. The vibrator roll 42 is driven by a belt 44 connected to a motor 46. The fabric forms a tension control loop 48 which is monitored by a combination of a light source 50 and optical sensor 52. If the tension control loop 48 drops to the point where the sensor is blocked, the drive motor 80 will speed up and when the sensor is not blocked, the drive motor 80 will slow down to maintain the loop in an equilibrium state.

There is a uniaxial vibrator roll 54 which rotates in a counter-clockwise direction, as shown in FIGS. 1, by means of a second motor 56 utilizing a belt 58. This uniaxial vibrator roll 54 serves to maintain the tension control loop 48. If the uniaxial vibrator roll 54 is stopped and its rotational direction reversed, the tension control loop 48 is stretched out and follows the alternative path as shown in FIG. 2. The alternative tension control loop 60 is formed by this alternative path. In this configuration, the pile fabric 12 makes contact with the counter-clockwise rotating second uniaxial vibrator roll 62, as shown in FIG. 2, driven by motor 64 by means of belt 66. However, the pile fabric 12 now avoids contact with biaxial vibrator roll 42. The configuration shown in FIG. 2 is used when the face of the pile fabric is especially sensitive to the more severe biaxial treatment. Since the pile fabric 12 cools rapidly, a radiant panel 68 is used to bring the pile fabric 12 back up to the temperature of the bottom of the heat zone 26.

A third motor-driven uniaxial vibrator roll 70 rotating clockwise as shown in FIGS. 1 and 2, and driven by motor 221 by means of belt 220 as shown in FIG. 3, makes contact with the back of the pile fabric 12 and a second vacuum head 72 with associated hose 74 and exhaust manifold 76 is used to remove any residual lint from the pile fabric 12.

The pile fabric 12 then proceeds toward an exit drive roll 78 powered by motor 80. The pile fabric then travels over exit idler rolls 82, 84 and 86 and then out of the apparatus 10. The fabric travels a sufficient distance between the last vibrator roll 70 and the idler roll 82 to allow the fabric 12 to cool so that pile distortion does not occur when the fabric face contacts idler roll 82.

The apparatus frame 40 has a three tiered base 302 with biaxial vibrator roll 32, uniaxial vibrator roll 70, and radiant panel 68 are attached to the underside of top tier 304. Biaxial vibrator roll 42, uniaxial vibrator roll 54 and uniaxial vibrator roll 62 are mounted on the top of middle tier 306 and motor 46, motor 56, motor 64, motor 221 and motor 211 are attached to the underside of middle tier 306. Bottom tier 308 and side members 310 and 312 form the side structure of the three tiered base 302. The bank of radiant heating elements 22 form a first rectangular structure 314 with idler roll 14 and 20 mounted on the top. There is a second rectangular structure 318 which has idler rolls 82 and 84 mounted on the inside, drive roll 16 mounted on top and exit drive roll 78 and idler roll 86 on the outer face of the second rectangular structure 318. Rectangular structure 314 is connected to rectangular structure 318 by a reinforcing bar 316.

Figure 7:
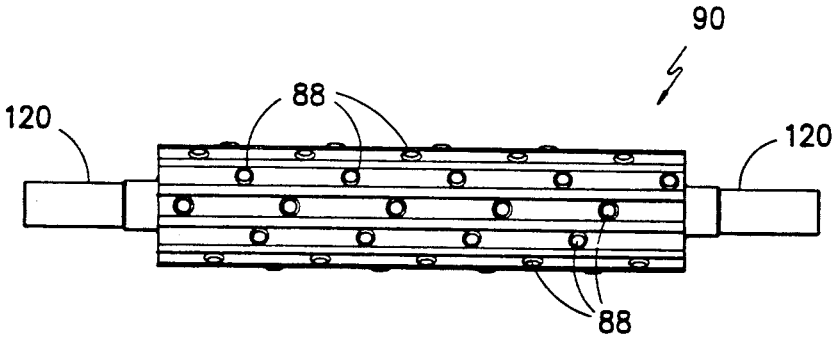
FIG. 7 is a front view of a biaxial vibrator roll.
Figure 8:
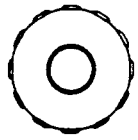
FIG. 8 is a side view of a biaxial vibrator roll.

The biaxial vibrator roll 32 and 42, as shown in FIGS. 7 and 8, consists of rounded steel disks 88 bolted to a cylindrical roll as shown generally as 90 with reduced diameter cylindrical journals 120 at each end of the cylindrical roll 90. The total number of rows of disks can vary depending on the size of the roll, but typically ranges between 3 and 36. In the preferred embodiment, the cylindrical roll 90 has twelve rows of disks 88. When measured from one side of cylinder 90, the ratio of the distance between each axially adjacent steel disk 88 to the width of each steel disk should preferably be less than three and more than one. If this ratio is less than one, then streaks will result because the coverage will be less than one hundred percent. If the ratio is too large, the individual steel disks 88 will cease to act as individual elements so that a biaxial roll will respond in the same manner as a uniaxial vibrator roll.

Figure 5:
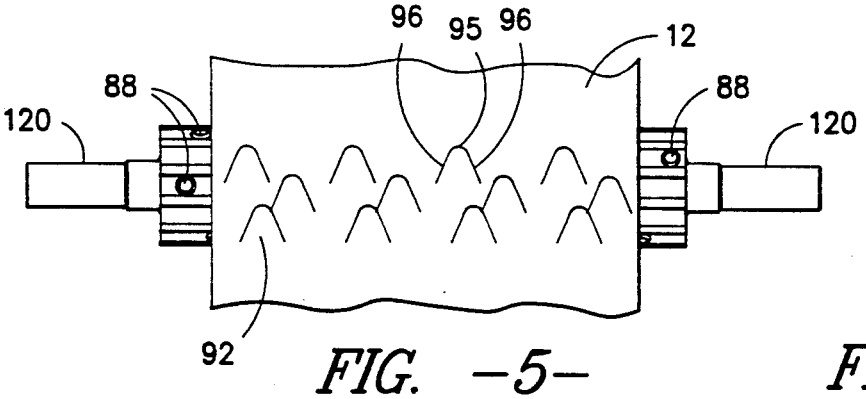
FIG. 5 is a front view of a biaxial vibrator roll creating instantaneous waveforms in fabric.
Figure 6:
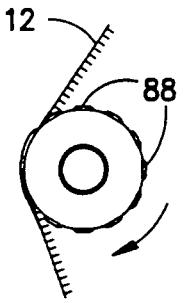
FIG. 6 is a side view of a biaxial vibrator roll creating instantaneous waveforms in fabric.

Referring now to FIGS. 5 and 6, the typical instantaneous wave form created by the rotation of the uniaxial vibrator roll in contact with the fabric is shown. Each of the twelve rows of steel disks 88 produce a set of waves or wakes 92 that are shifted axially with respect to the other eleven rows. At the center of the leading edge of the wake 95, the pile fibers are being bent back and forth in the warp direction which is along the longitudinal axis of the fabric 12. At the sides of the wake 96, the fibers are bent in a predominately fill-wise or lateral direction. The combined action of all twelve rows when summed produced biaxial motion in the fabric 12 which is everywhere practically the same.

Figure 4:
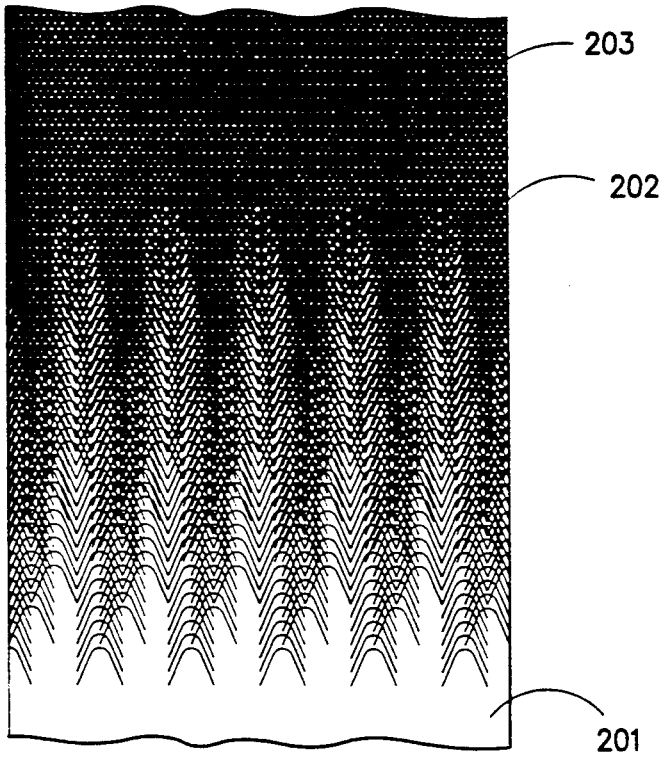
FIG. 4 is a top plan view of fabric illustrating the cumulative treatment produced by a biaxial vibrator roll.

The waveforms created by each of the twelve rows of steel disks 88 on a biaxial roll are located at discrete intervals in FIG. 4 to illustrate the overlapping coverage obtained. The point where the fabric 12 makes contact with the biaxial roll is designated by numeral 201. The point where the fabric has complete coverage is designated by numeral 202 and the point where the biaxial roll is almost starting to end contact with the fabric is at numeral 203.

Figure 9:
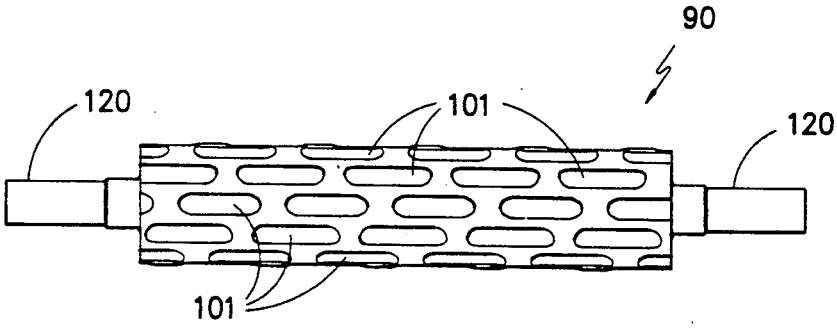
FIG. 9 is a front view of an alternative construction of a biaxial vibrator roll.
Figure 10:
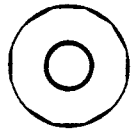
FIG. 10 is a side view of an alternative construction of a biaxial vibrator roll.

In the alternative, the biaxial vibrator roll can be designed with flats 101 intermittently milled into the cylindrical roll 90 which replace the steel disks 88 as shown in FIGS. 9 and 10. The flats 101 are spaced in the same pattern as the disks 88, but the fabric is vibrated by being pulled into the depressions created by the flats 101, rather than pushed out by the disks 88. The treatment is less vigorous with regard to the pile fabric 12 than the use of disks 88.

Figure 11:
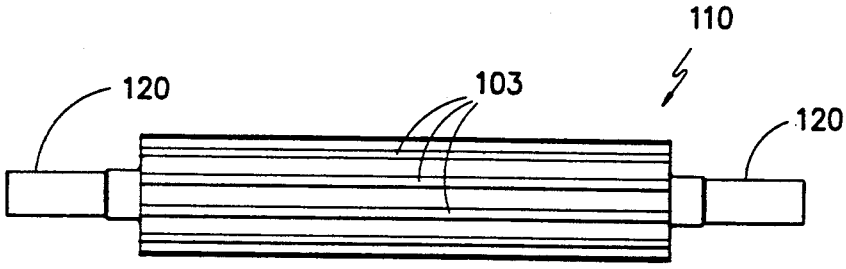
FIG. 11 is a front view of a uniaxial vibrator roll.
Figure 12:
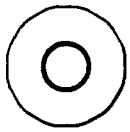
FIG. 12 is a side view of a uniaxial vibrator roll.

The uniaxial roll, generally shown as numeral 110 in FIGS. 11 and 12, comprises a series of flats 103 milled in cylindrical roll 90. This roll 110 can range from a cylinder with slightly flattened areas along the sides to a polygon in cross section. Both uniaxial roll 110 and biaxial roll 90 have reduced diameter journals 120 in the same manner as biaxial roll 32 and 42.

The vibrator rolls can rotate over a wide range of speeds, preferably between 500 to 4000 revolutions per minute with the optimal speed being 2000 revolutions per minute. The preferred motor is a five horsepower electric motor, although any of a wide variety of motors of various horsepower will suffice including those which are hydraulic, pneumatic, and so forth. The vibrator rolls can be virtually of any diameter with the preferred value being six inches.

It is not intended that the scope of the invention be limited to the specific embodiment illustrated and described. Rather, it is intended that the scope of the invention be defined by the appended claims and their equivalents.

What is claimed is:

1. A process for the continuous treatment of a web of thermoplastic pile fabric comprising:

(a) heating said fabric above a dyeing temperature of said fabric and below a heat-setting temperature of said fabric; and (b) vibrating said fabric biaxially by means of a rotating first cylindrical roll having an exterior surface and including spaced protrusions mounted on said exterior surface.

2. The process according to claim 1, wherein said fabric after being vibrated biaxially is vibrated uniaxially by means of a rotating second cylindrical roll having a longitudinal axis and including flat portions continuously extending along said longitudinal axis of said second cylindrical roll.

3. The process according to claim 1, wherein said heating is maintained throughout the vibrating of the fabric.

4. The process according to claim 1, wherein said heating is between 270 and 360 degrees Fahrenheit.

5. The process according to claim 1, wherein said protrusions are rounded disks.

6. The process according to claim 5, wherein a ratio of said rounded disk diameter to a distance between longitudinally adjacent disk centers is more than one and less than three.

7. The process according to claim 1, wherein said protrusions are aligned in rows and said rows number between three and thirty-six.

8. A process for the continuous treatment of a web of thermoplastic pile fabric comprising:

(a) heating said fabric above a dyeing temperature of said fabric and below a heat-setting temperature of said fabric;

(b) vibrating said fabric biaxially by means of a plurality of rotating first cylindrical rolls having an exterior surfaces and including spaced protrusion mounted on said exterior surfaces of said first cylindrical rolls; and (c) vibrating said fabric uniaxially by means of a plurality of rotating second cylindrical rolls having a longitudinal axes and including flat portions continuously extending along said longitudinal axes of said second cylindrical rolls.

9. A process for the continuous treatment of a web of thermoplastic pile fabric comprising:

(a) heating said fabric above a dyeing temperature of said fabric and below a heat-setting temperature of said fabric;

(b) vibrating said fabric biaxially by means of a rotating first cylindrical roll having an exterior surface and including a plurality of spaced depressions on said exterior surface of said first cylindrical roll; and (c) vibrating said fabric uniaxially by means of a rotating second cylindrical roll having a longitudinal axis and including flat portions continuously extending along said longitudinal axis of said second cylindrical roll.

10. The process according to 9, wherein said heating is between 270 and 360 degrees Fahrenheit.

11. The process according to claim 9, wherein a ratio of a longitudinal length of the depressions to a distance between longitudinally adjacent depressions is more than one but less than three.

12. The process according to claim 9, wherein said depressions are aligned in rows and said rows number between three and thirty-six.

13. The process according to claim 9, wherein said heating is maintained throughout the vibrating of the fabric.

14. A process for the continuous treatment of a web of thermoplastic pile fabric comprising:

(a) heating said fabric above a dyeing temperature of said fabric and below a heat-setting temperature of said fabric;

(b) vibrating said fabric biaxially by means of a plurality of rotating first cylindrical rolls having an exterior surface and including spaced depressions located on said exterior surfaces of said first cylindrical rolls; and (c) vibrating said fabric uniaxially by means of a plurality of rotating second cylindrical rolls having a longitudinal axes and including flat portions continuously extending along said longitudinal axes of said second cylindrical rolls.

15. A process for the continuous treatment of a web of thermoplastic pile fabric comprising:

(a) heating said fabric above a dyeing temperature of said fabric and below a heat-setting temperature of said fabric;

(b) vibrating said fabric biaxially by means of a rotating first cylindrical roll having an exterior surface and including spaced protrusions mounted on said exterior surface of said first cylindrical roll;

(c) vibrating said fabric biaxially by means of a rotating second cylindrical roll having an exterior surface and including spaced protrusions mounted on said exterior surface of said second cylindrical roll; and (d) vibrating said fabric uniaxially by means of a rotating third cylindrical roll having a longitudinal axis and including flat portions continuously extending along said longitudinal axis of said third cylindrical roll.

16. A process for the continuous treatment of a web of thermoplastic fabric having two sides comprising:

(a) heating said fabric above a dyeing temperature of said fabric and below a heat-setting temperature of said fabric;

(b) vibrating said fabric biaxially by means of a rotating first cylindrical roll having an exterior surface and including spaced protrusions mounted on said exterior surface of said first cylindrical roll;

(c) vibrating said fabric biaxially by means of a rotating second cylindrical roll having an exterior surface and including spaced protrusions mounted on said exterior surface of said second cylindrical roll;

(d) vibrating said fabric uniaxially by means of a rotating third cylindrical roll having a longitudinal axis and including flat portions continuously extending along said longitudinal axis of said third cylindrical roll; and (e) vibrating said fabric uniaxially by means of a rotating fourth cylindrical roll having a longitudinal axis and including flat portions continuously extending along said longitudinal axis of said third cylindrical roll.

17. The process according to claim 16, wherein said first cylindrical roll vibrates one side of the fabric and said second cylindrical roll vibrates the other side of the fabric.

18. The process according to claim 16, wherein said third cylindrical roll rotates in a direction which creates a first loop of fabric between said second cylindrical roll and said third cylindrical roll.

19. The process according to claim 16, wherein said rotational direction of said third cylindrical roll is reversed eliminating said first loop of fabric and causing said fabric to avoid contact with said second cylindrical roll.

20. The process according to claim 19, wherein said fabric is vibrated uniaxially by means of a fifth cylindrical roll and said fifth cylindrical roll is located between said third cylindrical roll and said fourth cylindrical roll and said fifth cylindrical roll includes a longitudinal axis and flat portion continuously extending along said longitudinal axis of said fifth cylindrical roll.

21. The process according to claim 20, wherein said fifth cylindrical roll rotates in a direction which creates a second loop of fabric between said third cylindrical roll and said fifth cylindrical roll.

22. A process for the continuous treatment of a web of thermoplastic pile fabric comprising:

(a) heating said fabric above a dyeing temperature of said fabric and below a heat-setting temperature of said fabric;

(b) vibrating said fabric biaxially by means of a rotating first cylindrical roll having an exterior surface and including spaced protrusions mounted on said exterior surface of said first cylindrical roll;

(c) vibrating said fabric uniaxially by means of a rotating second cylindrical roll having a longitudinal axis and including flat portions continuously extending along said longitudinal axis of said second cylindrical roll;

(d) vibrating said fabric uniaxially by means of a rotating third cylindrical roll having a longitudinal axis and including flat portions continuously extending along said longitudinal axis of said third cylindrical roll; and (e) vibrating said fabric uniaxially by means of a rotating fourth cylindrical roll having a longitudinal axis and including flat portions continuously extending along said longitudinal axis of said further cylindrical roll.

23. The process according to claim 22, wherein depressions are substituted for said protrusions.

24. An apparatus for the continuous treatment of a web of thermoplastic pile fabric comprising:

(a) a frame;

(b) a rotating first cylindrical roll operatively connected to said frame and having an exterior surface and including spaced protrusions mounted on said exterior surface of said first cylindrical roll and including a means for biaxial vibration;

(c) a means to heat said fabric operatively connected to said frame; and (d) a means for moving said fabric along a preselected path past said heating means and said first cylindrical roll.

25. An apparatus according to claim 24 in which a rotating second cylindrical roll operatively connected to said frame having a longitudinal axis and including flat portions continuously extending along said longitudinal axis of said second cylindrical roll including a means for uniaxial vibration.

26. A apparatus for the continuous treatment of a web of thermoplastic pile fabric comprising:

(a) a frame;

(b) a plurality of rotating first cylindrical rolls operatively connected to said frame and having an exterior surface and including spaced protrusions mounted on said exterior surface of said first cylindrical rolls including a means for biaxial vibration;

(c) a plurality of rotating second cylindrical rolls operatively connected to said frame and having a longitudinal axes and including flat portions continuously extending along said longitudinal axes of said second cylindrical rolls including a means for uniaxial vibration;

(d) a means to heat said fabric operatively connected to said frame; and (d) a means for moving said fabric along a preselected path past said heating means and said first cylindrical rolls and said second cylindrical rolls.

27. A apparatus for the continuous treatment of a web of thermoplastic pile fabric comprising:

(a) a frame;

(b) a rotating first cylindrical roll operatively connected to said frame and having an exterior surface and including spaced depressions located on said exterior surface of said first cylindrical roll including a means for biaxial vibration;

(c) a rotating second cylindrical roll operatively connected to said frame and having a longitudinal axes and including flat portions continuously extending along said longitudinal axes of said second cylindrical roll including a means for uniaxial vibration;

(d) a means to heat said fabric operatively connected to said frame; and (d) a means for moving said fabric along a preselected path past said heating means and said first cylindrical roll and said second cylindrical roll.

28. A apparatus for the continuous treatment of a web of thermoplastic pile fabric comprising:

(a) a frame;

(b) a rotating first cylindrical roll operatively connected to said frame and having an exterior surface and including spaced protrusions mounted on said exterior surface of said first cylindrical roll including a means for biaxial vibration;

(c) a rotating second cylindrical roll operatively connected to said frame and having an exterior surface and including spaced protrusions mounted on said exterior surface of said second cylindrical roll including a means for biaxial vibration;

(d) a rotating third cylindrical roll operatively connected to said frame and having a longitudinal axes and including flat portions continuously extending along said longitudinal axes of said third cylindrical roll including a means for uniaxial vibration;

(e) a rotating fourth cylindrical roll operatively connected to said frame and having a longitudinal axes and including flat portions continuously extending along said longitudinal axes of said fourth cylindrical roll including a means for uniaxial vibration;

(f) a means to heat said fabric operatively connected to said frame; and (g) a means for moving said fabric along a preselected path past said heating means and said first cylindrical roll and said second cylindrical roll and said third cylindrical roll and said fourth cylindrical roll.

29. An apparatus according to claim 28, wherein said heating is above a dyeing temperature of the fabric and below a heat-setting temperature.

30. An apparatus according to claim 29, wherein said heating is between 270 and 360 degrees Fahrenheit.

31. An apparatus according to claim 30, wherein said heating is above a dyeing temperature of the fabric and below a heat-setting temperature.

32. An apparatus according to claim 31, wherein said heating is between 270 and 360 degrees Fahrenheit.

33. An apparatus according to claim 30, wherein said protrusions are rounded disks.

34. An apparatus according to claim 33, wherein a ratio of a rounded disk diameter to a longitudinal distance between axially adjacent disk centers is more than one and less than three.

35. An apparatus according to claim 30, wherein said protrusions are aligned in rows and said rows number between three and thirty-six.

36. An apparatus according to claim 28, wherein said protrusions are rounded disks.

37. An apparatus according to claim 36, wherein a ratio of a rounded disk diameter to a longitudinal distance between axially adjacent disk centers is more than one and less than three.

38. An apparatus according to claim 28, wherein said protrusions are aligned in rows and said rows number between three and thirty-six.

39. An apparatus for the continuous treatment of a web of thermoplastic pile fabric comprising:

(a) a frame;

(b) a rotating first cylindrical roll operatively connected to said frame and having an exterior surface and including spaced depressions located on said exterior surface of said first cylindrical roll including a means for biaxial vibration;

(c) a rotating second cylindrical roll operatively connected to said frame and having an exterior surface and including spaced depressions located on said exterior surface of said second cylindrical roll including a means for biaxial vibration;

(d) a rotating third cylindrical roll operatively connected to said frame and having a longitudinal axes and including flat portions continuously extending along said longitudinal axes of said third cylindrical roll including a means for uniaxial vibration;

(e) a rotating fourth cylindrical roll operatively connected to said frame and having a longitudinal axes and including flat portions continuously extending along said longitudinal axes of said fourth cylindrical roll including a means for uniaxial vibration;

(f) a means to heat said fabric operatively connected to said frame; and (g) a means for moving said fabric along a preselected path past said heating means and said first cylindrical roll and said second cylindrical roll and said third cylindrical roll and said fourth cylindrical roll.

40. An apparatus for the continuous treatment of a web of thermoplastic pile fabric comprising:

(a) a frame;

(b) a rotating first cylindrical roll operatively connected to said frame and having an exterior surface and including spaced protrusions mounted on said exterior surface of said first cylindrical roll including a means for biaxial vibration;

(c) a rotating second cylindrical roll operatively connected to said frame and having a longitudinal axis and including flat portions continuously extending along said longitudinal axis of said second cylindrical roll including a means for uniaxial vibration;

(d) a rotating third cylindrical roll operatively connected to said frame and having a longitudinal axis and including flat portions continuously extending along said longitudinal axis of said third cylindrical roll including a means for uniaxial vibration;

(e) a rotating fourth cylindrical roll operatively connected to said frame and having a longitudinal axis and including flat portions continuously extending along said longitudinal axis of said fourth cylindrical roll including a means for uniaxial vibration;

(f) a means to eat said fabric operatively connected to said frame; and (g) a means for moving said fabric along a preselected path past said first cylindrical roll and said second cylindrical roll and said third cylindrical roll and said fourth cylindrical roll and said heating means.

41. An apparatus according to claim 40, in which depressions are substituted for said protrusions.

* * * * *